US011538374B2

(12) United States Patent
Choi et al.

(10) Patent No.: US 11,538,374 B2
(45) Date of Patent: Dec. 27, 2022

(54) POWER VOLTAGE GENERATOR, DISPLAY APPARATUS HAVING THE SAME AND METHOD OF DRIVING THE SAME

(71) Applicant: Samsung Display Co., Ltd., Yongin-Si (KR)

(72) Inventors: Sung Soo Choi, Anyang-si (KR); Dae-Sik Lee, Hwaseong-si (KR); Ji Youn Seo, Asan-si (KR); Gwang Soo Ahn, Suwon-si (KR); Jong Jae Lee, Hwaseong-si (KR); Geun Hyuk Choi, Suncheon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/181,309

(22) Filed: Feb. 22, 2021

(65) Prior Publication Data

US 2021/0335166 A1 Oct. 28, 2021

(30) Foreign Application Priority Data

Apr. 24, 2020 (KR) ..... 10-2020-0050214

(51) Int. Cl.
*G09G 3/20* (2006.01)
*G09G 3/00* (2006.01)

(52) U.S. Cl.
CPC ..... *G09G 3/006* (2013.01); *G09G 3/20* (2013.01); *G09G 2310/061* (2013.01); *G09G 2310/08* (2013.01); *G09G 2330/028* (2013.01)

(58) Field of Classification Search
CPC .... G09G 3/006; G09G 3/20; G09G 2310/061; G09G 2310/08; G09G 2330/028; G09G 2300/0426; G09G 3/2092; G09G 3/3611; G09G 3/3696; G02F 1/136204; G02F 1/136286
See application file for complete search history.

(56) References Cited

U.S. PATENT DOCUMENTS

| | | | | |
|---|---|---|---|---|
| 8,976,101 | B2 * | 3/2015 | Chang | G09G 3/3648 345/98 |
| 9,166,393 | B2 * | 10/2015 | Kawata | H03K 17/0822 |
| 9,672,087 | B2 * | 6/2017 | Lee | G09G 3/3674 |
| 10,741,113 | B2 * | 8/2020 | Lee | G09G 3/006 |
| 10,950,323 | B2 * | 3/2021 | Xiong | G09G 3/20 |
| 2006/0050027 | A1 * | 3/2006 | Meguro | G09G 3/006 345/75.2 |
| 2006/0262069 | A1 * | 11/2006 | Do | G09G 3/3688 345/98 |

(Continued)

FOREIGN PATENT DOCUMENTS

| | | | |
|---|---|---|---|
| KR | 1020150009208 | A | 1/2015 |
| KR | 1020150081867 | A | 7/2015 |

(Continued)

*Primary Examiner* — Jose R Soto Lopez
(74) *Attorney, Agent, or Firm* — Cantor Colburn LLP

(57) ABSTRACT

A power voltage generator includes a voltage sensor and a power controller. The voltage sensor is configured to sense a first voltage in a first charge sharing period of a gate clock signal and a second voltage in a second charge sharing period of the gate clock signal. The power breaker is configured to disconnect a power based on the first voltage and the second voltage.

20 Claims, 7 Drawing Sheets

(56) References Cited

U.S. PATENT DOCUMENTS

2007/0040789 A1* 2/2007 Ha ..... G09G 3/3677 345/98
2007/0159438 A1* 7/2007 Cho ..... G09G 3/3677 345/98
2007/0296661 A1* 12/2007 Ishiguchi ..... G09G 3/3688 345/87
2008/0030490 A1* 2/2008 Son ..... G09G 3/3648 345/205
2008/0218232 A1* 9/2008 Jeon ..... G09G 3/20 327/165
2009/0027322 A1* 1/2009 Hosotani ..... G09G 3/3688 345/87
2009/0146993 A1* 6/2009 Lee ..... G09G 3/3677 345/87
2010/0066719 A1* 3/2010 Hirao ..... G09G 3/3688 345/98
2010/0085348 A1* 4/2010 Bae ..... G09G 3/3648 345/99
2010/0207919 A1* 8/2010 Sawahata ..... G09G 3/3648 345/96
2010/0238151 A1* 9/2010 Kitayama ..... G09G 3/3614 345/209
2011/0148893 A1* 6/2011 An ..... G09G 3/3614 345/545
2012/0327128 A1* 12/2012 Li ..... G09G 3/32 345/83
2013/0050176 A1* 2/2013 Kim ..... G09G 3/3688 345/87
2013/0082996 A1* 4/2013 Kim ..... G09G 3/3677 345/95
2013/0201174 A1* 8/2013 Pyun ..... G09G 3/3614 345/213
2013/0314392 A1* 11/2013 Kim ..... G09G 3/3266 345/212
2014/0049532 A1* 2/2014 Choi ..... G09G 5/00 345/213
2014/0104248 A1* 4/2014 Won ..... G09G 3/3696 345/204
2014/0146265 A1* 5/2014 Nakamizo ..... G09G 3/3655 349/54
2014/0210700 A1* 7/2014 Won ..... G09G 3/3677 345/102
2014/0320464 A1* 10/2014 Ryu ..... G09G 3/3688 345/204
2014/0340380 A1* 11/2014 Song ..... G09G 3/3266 345/212
2015/0009599 A1* 1/2015 Zhang ..... G09G 3/3677 361/87
2015/0116307 A1* 4/2015 Kim ..... G09G 3/3696 323/318
2015/0187314 A1* 7/2015 Choi ..... G09G 3/2092 345/99
2015/0187317 A1* 7/2015 Seo ..... G09G 3/006 345/212
2015/0194800 A1* 7/2015 Kim ..... G09G 3/3677 361/95
2015/0221275 A1* 8/2015 Shin ..... G09G 3/3648 345/99
2015/0268289 A1* 9/2015 Onodera ..... G01R 31/52 324/750.3
2016/0275898 A1* 9/2016 Qin ..... G09G 3/3696
2017/0011699 A1* 1/2017 Wang ..... G11C 19/28
2017/0032755 A1* 2/2017 Ko ..... G09G 3/3688
2017/0039974 A1* 2/2017 Kang ..... G09G 3/3677
2017/0162123 A1* 6/2017 Choi ..... G09G 3/3291
2017/0229055 A1* 8/2017 Hu ..... G09G 3/2092
2017/0316728 A1* 11/2017 Lee ..... G09G 3/3266
2017/0316748 A1* 11/2017 Shim ..... G09G 3/3607
2018/0012533 A1* 1/2018 Lee ..... G09G 3/2092
2018/0061352 A1* 3/2018 Kim ..... G09G 3/3696
2018/0233105 A1* 8/2018 Cho ..... G09G 3/204
2019/0027109 A1* 1/2019 Lee ..... G09G 3/3688
2019/0081471 A1* 3/2019 Park ..... H02H 3/08
2019/0156716 A1* 5/2019 Kim ..... G09G 3/20
2019/0172387 A1* 6/2019 Choi ..... H03M 1/66
2020/0074952 A1* 3/2020 Tominaga ..... G09G 3/3677
2020/0394968 A1* 12/2020 Kwon ..... G09G 3/3291
2021/0104203 A1* 4/2021 Ueno ..... G09G 3/3677

FOREIGN PATENT DOCUMENTS

KR 1020180118855 A 11/2018
KR 1020200007112 A 1/2020

* cited by examiner

POWER VOLTAGE GENERATOR, DISPLAY APPARATUS HAVING THE SAME AND METHOD OF DRIVING THE SAME

This application claims priority to Korean Patent Application No. 10-2020-0050214, filed on Apr. 24, 2020, and all the benefits accruing therefrom under 35 U.S.C. § 119, the content of which in its entirety is herein incorporated by reference.

BACKGROUND

1. Field

Embodiments of the present inventive concept relate to a power voltage generator, a display apparatus including the power voltage generator, and a method of driving the display apparatus. More particularly, embodiments of the present inventive concept relate to sense a short between gate clock signal lines to enhance safety and reliability, a display apparatus including the power voltage generator, and a method of driving the display apparatus.

2. Description of the Related Art

Generally, a display apparatus includes a display panel and a display panel driver. The display panel displays an image based on an input image. The display panel includes a plurality of gate lines, a plurality of data lines, and a plurality of pixels. The display panel driver includes a gate driver providing gate signals to the gate lines, a data driver providing data voltages to the data lines, a driving controller controlling the gate driver and the data driver, and a power voltage generator providing power voltages to the display panel, the gate driver and the data driver.

SUMMARY

When a short occurs between signal transmitting lines in a portion of the display apparatus, heat or fire may be generated in the display apparatus. Thus, when the short occurs between the signal transmitting lines in the portion of the display apparatus, a power to the display apparatus is desired to be disconnected.

Embodiments of the present inventive concept provide a power voltage generator capable of sensitively detecting a short between gate clock signal lines to enhance safety and reliability.

Embodiments of the present inventive concept also provide a display apparatus including the power voltage generator.

Embodiments of the present inventive concept also provide a method of driving the display apparatus.

In an embodiment of a power voltage generator according to the present inventive concept, the power voltage generator includes a voltage sensor and a power breaker. The voltage sensor is configured to sense a first voltage in a first charge sharing period of a gate clock signal and a second voltage in a second charge sharing period of the gate clock signal. The power breaker is configured to disconnect a power based on the first voltage and the second voltage.

In an embodiment, the power voltage generator may further include a comparator which compares an absolute value of a difference of the first voltage and the second voltage to a threshold value to generate a comparison signal.

In an embodiment, the gate clock signal and a gate inverted clock signal which is an inverted signal of the gate clock signal may be temporarily connected to each other in the first charge sharing period.

In an embodiment, the first charge sharing period may correspond to a falling period of the gate clock signal, and the second charge sharing period may correspond to a rising period of the gate clock signal.

In an embodiment, the first charge sharing period and the second charge sharing period may be controlled in response to a gate clock control signal.

In an embodiment, the voltage sensor may be configured to sense the first voltage at a rising edge of a first pulse of the gate clock control signal. The voltage sensor may be configured to sense the second voltage at a rising edge of a second pulse of the gate clock control signal adjacent to the first pulse of the gate clock control signal.

In an embodiment, the first charge sharing period and the second charge sharing period may be included in an active period when an image is written on a display area of a display panel. The voltage sensor may be configured to sense the first voltage and the second voltage in the active period.

In an embodiment, a length of a blank charge sharing period included in a vertical blank period when an image is not written on a display area of a display panel may be longer than a length of an active charge sharing period included in an active period when an image is written on the display area of the display panel.

In an embodiment, the first charge sharing period and the second charge sharing period may be the blank charge sharing period included in the vertical blank period. The voltage sensor may be configured to sense the first voltage and the second voltage in the vertical blank period.

In an embodiment, the active charge sharing period and the blank charge sharing period may be controlled in response to a gate clock control signal. A pulse width of the gate clock control signal in the vertical blank period may be wider than a pulse width of the gate clock control signal in the active period.

In an embodiment of a display apparatus according to the present inventive concept, the display apparatus includes a display panel, a gate driver, a data driver, a power voltage generator. The display panel includes a gate line, a data line, and a pixel electrically connected to the gate line and the data line. The display panel is configured to display an image based on input image data. The gate driver is configured to output a gate signal to the gate line. The data driver is configured to output a data voltage to the data line. The power voltage generator is configured to provide driving voltages to the display panel, the gate driver and the data driver. The power voltage generator includes a voltage sensor which senses a first voltage in a first charge sharing period of a gate clock signal and a second voltage in a second charge sharing period of the gate clock signal and a power breaker which stops providing the driving voltages based on the first voltage and the second voltage.

In an embodiment, the gate driver may be disposed in the display panel. The power voltage generator may be configured to output the gate clock signal to the gate driver. The power voltage generator may be configured to stop providing the driving voltages when a short between the gate clock signal lines configured to apply the gate clock signals is detected.

In an embodiment, the first charge sharing period may correspond to a falling period of the gate clock signal and the second charge sharing period may correspond to a rising period of the gate clock signal.

In an embodiment, the display apparatus may further include a driving controller which outputs a gate clock control signal which controls the first charge sharing period and the second charge sharing period to the power voltage generator.

In an embodiment, the voltage sensor may be configured to sense the first voltage at a rising edge of a first pulse of the gate clock control signal. The voltage sensor may be configured to sense the second voltage at a rising edge of a second pulse of the gate clock control signal adjacent to the first pulse of the gate clock control signal.

In an embodiment, a length of a blank charge sharing period included in a vertical blank period when an image is not written on a display area of the display panel may be longer than a length of an active charge sharing period included in an active period when an image is written on the display area of the display panel.

In an embodiment, the first charge sharing period and the second charge sharing period may be the blank charge sharing period included in the vertical blank period. The voltage sensor may be which senses the first voltage and the second voltage in the vertical blank period.

In an embodiment of a method of driving a display apparatus, the method includes generating a gate clock signal based on a gate clock control signal, providing the gate clock control signal to a gate driver, sensing a first voltage in a first charge sharing period of the gate clock signal, sensing a second voltage in a second charge sharing period of the gate clock signal, detecting a short between gate clock signal lines based on the first voltage and the second voltage and stopping providing a power to the display apparatus when the short between the gate clock signal lines is detected.

In an embodiment, the first charge sharing period may correspond to a falling period of the gate clock signal, and the second charge sharing period may correspond to a rising period of the gate clock signal.

In an embodiment, a length of a blank charge sharing period included in a vertical blank period when an image is not written on a display area of a display panel may be longer than a length of an active charge sharing period included in an active period when an image is written on the display area of the display panel. The first charge sharing period and the second charge sharing period may be the blank charge sharing period included in the vertical blank period. A voltage sensor may be configured to sense the first voltage and the second voltage in the vertical blank period.

According to the power voltage generator, the display apparatus and the method of driving the display apparatus, the voltage of the gate clock signal is detected in a charge sharing period of the gate clock signal so that the short between the gate clock signal lines may be sensitively detected comparing to a conventional current sensing method.

During a vertical blank period when the image is not written on the display panel, the charge sharing period of the gate clock signal may be extended compared to the charge sharing period in the active period. When the voltage of the gate clock signal is sensed in the extended charge sharing period, the short between the gate clock signal lines may be more sensitively detected.

Thus, the heat or the fire of the display apparatus, which may be generated when the existing short between the gate clock signal lines is not detected, may be prevented. Specifically, the heat or the fire of the display apparatus, which may be generated when the short between the gate clock signal lines is not detected at a lower portion of the display panel, may be prevented. Thus, the safety and the reliability of the display apparatus may be enhanced.

BRIEF DESCRIPTION OF THE DRAWINGS

The above and other features and advantages of the present inventive concept will become more apparent by describing in detailed embodiments thereof with reference to the accompanying drawings, in which.

DETAILED DESCRIPTION

Hereinafter, the present inventive concept will be explained in detail with reference to the accompanying drawings. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Figure 1:
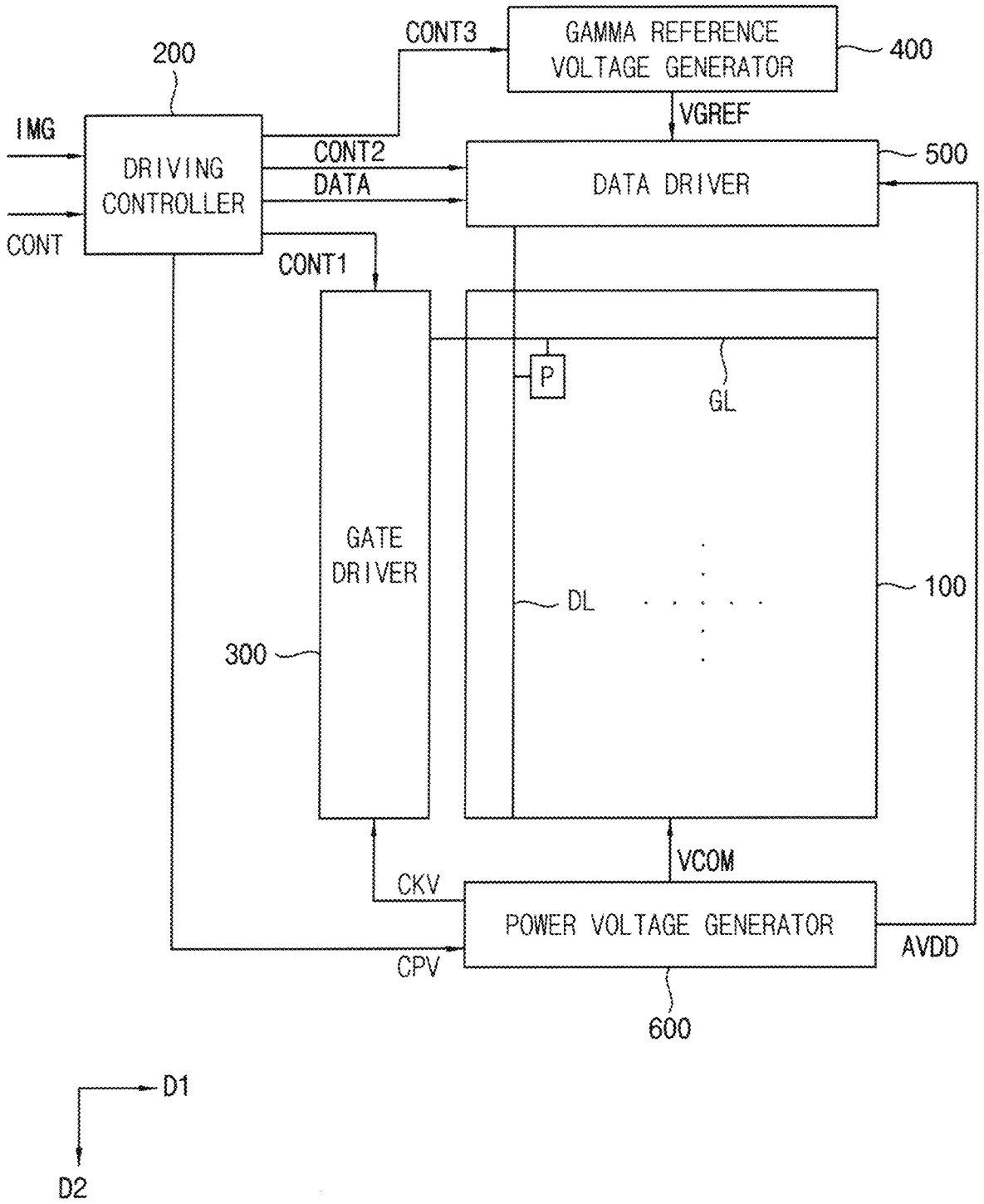
FIG. 1 is a block diagram illustrating a display apparatus according to an embodiment of the present inventive concept.

FIG. 1 is a block diagram illustrating a display apparatus according to an embodiment of the present inventive concept.

Referring to FIG. 1, the display apparatus includes a display panel 100 and a display panel driver. The display panel driver includes a driving controller 200, a gate driver 300, a gamma reference voltage generator 400 and a data driver 500. The display panel driver may further include a power voltage generator 600.

In an embodiment, for example, the driving controller 200 and the data driver 500 may be integrally formed. For another example, the driving controller 200, the gamma reference voltage generator 400 and the data driver 500 may be integrally formed. A driving module including at least the driving controller 200 and the data driver 500 which are integrally formed may be called as a timing controller embedded data driver ("TED").

The display panel 100 has a display region on which an image is displayed and a peripheral region adjacent to the display region.

The display panel 100 includes a plurality of gate lines GL, a plurality of data lines DL and a plurality of pixels connected to the gate lines GL and the data lines DL. The gate lines GL extend in a first direction D1, and the data lines DL extend in a second direction D2 crossing the first direction D1.

The driving controller 200 receives input image data IMG and an input control signal CONT from an external apparatus (not shown). The input image data IMG may include red image data, green image data, and blue image data. The input image data IMG may include white image data. In another embodiment, the input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and output the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. For example, the gate driver 300 may be mounted on the peripheral region of the display panel 100. For example, the gate driver 300 may be integrated in the peripheral region of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL. For example, the data driver 500 may be mounted on the peripheral region of the display panel 100. For example, the data driver 500 may be integrated in the peripheral region of the display panel 100.

The power voltage generator 600 may provide a power voltage to at least one of the display panel 100, the driving controller 200, the gate driver 300, the gamma reference voltage generator 400, and the data driver 500. For example, the power voltage generator 600 may include a direct current ("DC") to DC converter.

For example, the power voltage generator 600 may generate a common voltage VCOM and outputs the common voltage VCOM to the display panel 100. In the present embodiment, the display apparatus may be a liquid crystal display apparatus including a liquid crystal layer. However, the display apparatus of the present inventive concept may not be limited to the liquid crystal display apparatus.

In an embodiment, for example, the power voltage generator 600 may generate a gate clock signal CKV used for generating the gate signal and a gate-off voltage and a second gate-off voltage controlling an operation of the gate driver 300. The power voltage generator 600 may output the gate clock signal CKV, the gate-off voltage, and the second gate-off voltage to the gate driver 300.

The power voltage generator 600 may receive a gate clock control signal CPV from the driving controller 200. The power voltage generator 600 may generate a gate clock signal CKV based on the gate clock control signal CPV.

In an embodiment, for example, the power voltage generator 600 may generate an analog high voltage AVDD determining a level of the data voltage and output the analog high voltage AVDD to the data driver 500.

Figure 2:
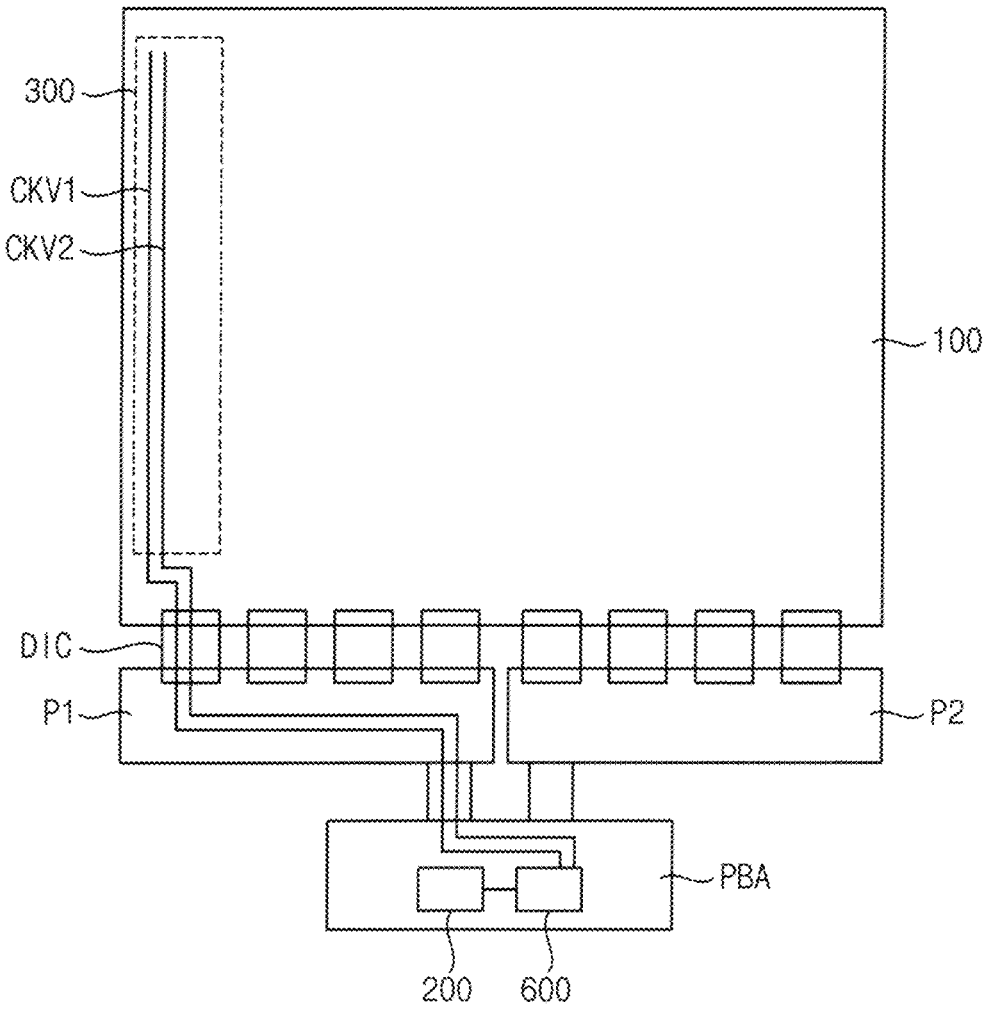
FIG. 2 is a plan view illustrating the display apparatus of FIG. 1.

FIG. 2 is a plan view illustrating the display apparatus of FIG. 1.

Referring to FIGS. 1 and 2, the driving controller 200 and the power voltage generator 600 may be disposed in a printed circuit board assembly PBA. The printed circuit board assembly PBA may be connected to a first printed circuit P1 and a second printed circuit P2.

For example, the data driver 500 may include a plurality of data driving chips DIC connected between the first printed circuit P1 and the display panel 100 and another plurality of data driving chips DIC connected between the second printed circuit P2 and the display panel 100.

In the present embodiment, the gate driver 300 may be disposed in the display panel 100. The power voltage generator 600 may output the gate clock signal (e.g. CKV1 and CKV2) to the gate driver 300 disposed in the display panel 100. Gate clock signal lines applying the gate clock signals CKV1 and CKV2 may be disposed on the display panel 100.

Figure 3:
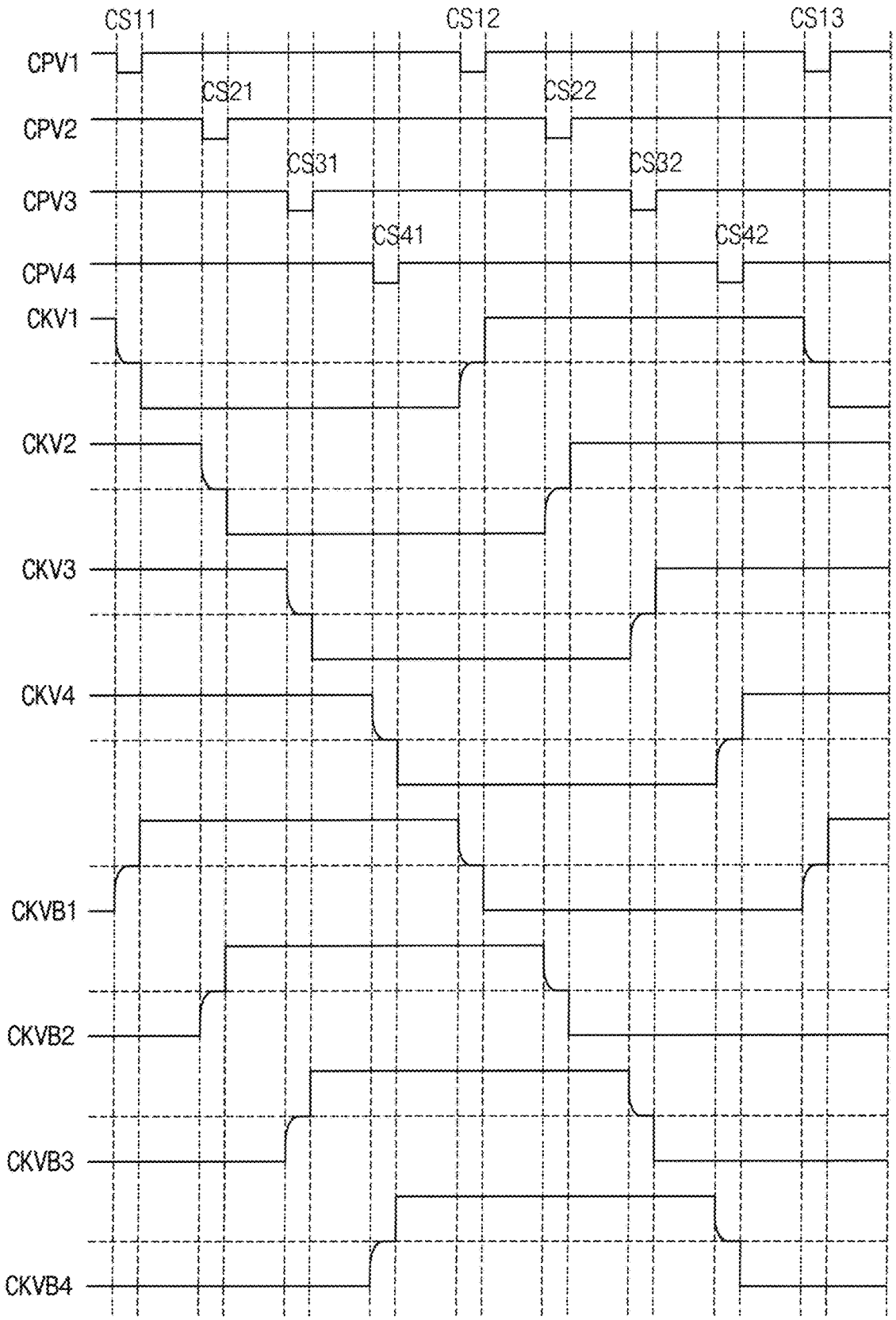
FIG. 3 is a timing diagram illustrating input signals and output signals of a power voltage generator of FIG. 1.

FIG. 3 is a timing diagram illustrating input signals and output signals of the power voltage generator 600 of FIG. 1.

Referring to FIGS. 1 to 3, the power voltage generator 600 may receive the gate clock control signal CPV from the driving controller 200 and generate the gate clock signal CKV based on the gate clock control signal CPV. The power voltage generator 600 may output the gate clock signal CKV to the gate driver 300 integrated on the display panel 100 through a gate clock signal line.

In FIG. 3, for example, the power voltage generator 600 may receive a plurality of the gate clock control signals CPV1, CPV2, CPV3 and CPV4 and may output a plurality of the gate clock signals CKV1, CKV2, CKV3, CKV4, CKVB1, CKVB2, CKVB3, and CKVB4.

For example, first to eighth gate clock signals CKV1 to CKV4 and CKVB1 to CKVB4 may have phases different from one another. The phases of the first to eighth gate clock signals CKV1 to CKV4 and CKVB1 to CKVB4 may be sequentially distributed in a uniform gap.

As shown in FIG. 3, the second gate clock signal CKV2 may have the phase lagging behind the phase of the first gate clock signal CKV1 by ⅛ of a cycle. The third gate clock signal CKV3 may have the phase lagging behind the phase of the second gate clock signal CKV2 by ⅛ of the cycle. The fourth gate clock signal CKV4 may have the phase lagging behind the phase of the third gate clock signal CKV3 by ⅛ of the cycle. The fifth gate clock signal CKVB1 may have the phase lagging behind the phase of the fourth gate clock signal CKV4 by ⅛ of the cycle. The sixth gate clock signal CKVB2 may have the phase lagging behind the phase of the fifth gate clock signal CKVB1 by ⅛ of the cycle. The seventh gate clock signal CKVB3 may have the phase lagging behind the phase of the sixth gate clock signal CKVB2 by ⅛ of the cycle. The eighth gate clock signal CKVB4 may have the phase lagging behind the phase of the seventh gate clock signal CKVB3 by ⅛ of the cycle.

The fifth to eighth gate clock signals CKVB1 to CKVB4 may be inverted signals of the first to fourth gate clock signals CKV1 to CKV4. That is, for example, the fifth gate clock signal CKVB1 may have the phase lagging behind the first gate clock signal CKV1 by ½ of the cycle.

The first gate clock signal CKV1 and a first gate inverted clock signal CKVB1 may change based on a first gate clock control signal CPV1.

In an embodiment, for example, the first gate clock signal CKV1 may fall and the first gate inverted clock signal CKVB1 may rise in response to a first pulse of the first gate clock control signal CPV1. For example, the first gate clock signal CKV1 may rise and the first gate inverted clock signal CKVB1 may fall in response to a second pulse of the first gate clock control signal CPV1.

The power voltage generator 600 may generate the first gate clock signal CKV1 and the first gate inverted clock signal CKVB1 by a charge sharing method.

In a first charge sharing period CS11 of the first gate clock signal CKV1, the first gate clock signal CKV1 and the first gate inverted clock signal CKVB1 may be temporarily connected to each other. When the first gate clock signal CKV1 and the first gate inverted clock signal CKVB1 are temporarily connected to each other in the first charge sharing period CS11, a level of the first gate clock signal CKV1 may decrease toward a middle level, and a level of the first gate inverted clock signal CKVB1 may increase toward the middle level. Herein, the first charge sharing period CS11 may correspond to the first pulse of the first gate clock control signal CPV1, and the first charge sharing period CS11 may correspond to a falling period of the first gate clock signal CKV1. A third charge sharing period CS13 corresponds to the first charge sharing period CS11. Therefore, the same thing may occur in the third charge sharing period CS13.

In a second charge sharing period CS12 of the first gate clock signal CKV1, the first gate clock signal CKV1 and the first gate inverted clock signal CKVB1 may be temporarily connected to each other. When the first gate clock signal CKV1 and the first gate inverted clock signal CKVB1 are temporarily connected to each other in the second charge sharing period CS12, a level of the first gate clock signal CKV1 may increase toward the middle level, and a level of the first gate inverted clock signal CKVB1 may decrease toward the middle level. Herein, the second charge sharing period CS12 may correspond to the second pulse of the first gate clock control signal CPV1, and the second charge sharing period CS12 may correspond to a rising period of the first gate clock signal CKV1.

The second gate clock signal CKV2 and a second gate inverted clock signal CKVB2 may change based on a second gate clock control signal CPV2.

In an embodiment, for example, the second gate clock signal CKV2 may fall and the second gate inverted clock signal CKVB2 may rise in response to a first pulse of the second gate clock control signal CPV2. For example, the second gate clock signal CKV2 may rise and the second gate inverted clock signal CKVB2 may fall in response to a second pulse of the second gate clock control signal CPV2.

The power voltage generator 600 may generate the second gate clock signal CKV2 and the second gate inverted clock signal CKVB2 by a charge sharing method.

In a first charge sharing period CS21 of the second gate clock signal CKV2, the second gate clock signal CKV2 and the second inverted gate clock signal CKVB2 may be temporarily connected to each other. When the second gate clock signal CKV2 and the second inverted gate clock signal CKVB2 are temporarily connected to each other in the first charge sharing period CS21, a level of the second gate clock signal CKV2 may decrease toward the middle level and a level of the second inverted gate clock signal CKVB2 may increase toward the middle level. Herein, the first charge sharing period CS21 may correspond to the first pulse of the second gate clock control signal CPV2.

In a second charge sharing period CS22 of the second gate clock signal CKV2, the second gate clock signal CKV2 and the second inverted gate clock signal CKVB2 may be temporarily connected to each other. When the second gate clock signal CKV2 and the second inverted gate clock signal CKVB2 are temporarily connected to each other in the second charge sharing period CS22, a level of the second gate clock signal CKV2 may increase toward the middle level and a level of the second inverted gate clock signal CKVB2 may decrease toward the middle level. Herein, the second charge sharing period CS22 may correspond to the second pulse of the second gate clock control signal CPV2.

In the same way as explained above, the third gate clock signal CKV3 and the third gate inverted clock signal CKVB3 may change based on a third gate clock control signal CPV3, and the fourth gate clock signal CKV4 and the fourth gate inverted clock signal CKVB4 may change based on a fourth gate clock control signal CPV4.

In addition, the power voltage generator 600 may generate the third gate clock signal CKV3 and the third gate inverted clock signal CKVB3 by a charge sharing method, and generate the fourth gate clock signal CKV4 and the fourth gate inverted clock signal CKVB4 by a charge sharing method.

In the present embodiment, for example, the number of the gate clock control signals is four, and the number of the gate clock signals is eight. However, the present inventive concept may not be limited the number of the gate clock control signals and the number of the gate clock signals.

Although pulses of the gate clock control signal CPV1, CPV2, CPV3, and CPV4 are low pulses having a low level in the present embodiment, the present inventive concept may not be limited thereto.

Figure 4:
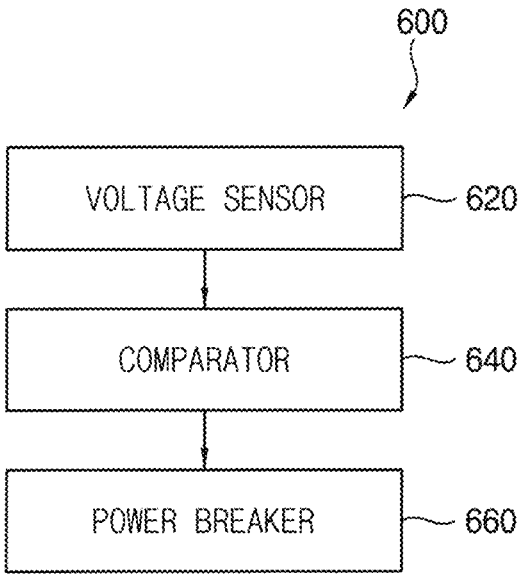
FIG. 4 is a block diagram illustrating the power voltage generator of FIG. 1.
Figure 5:
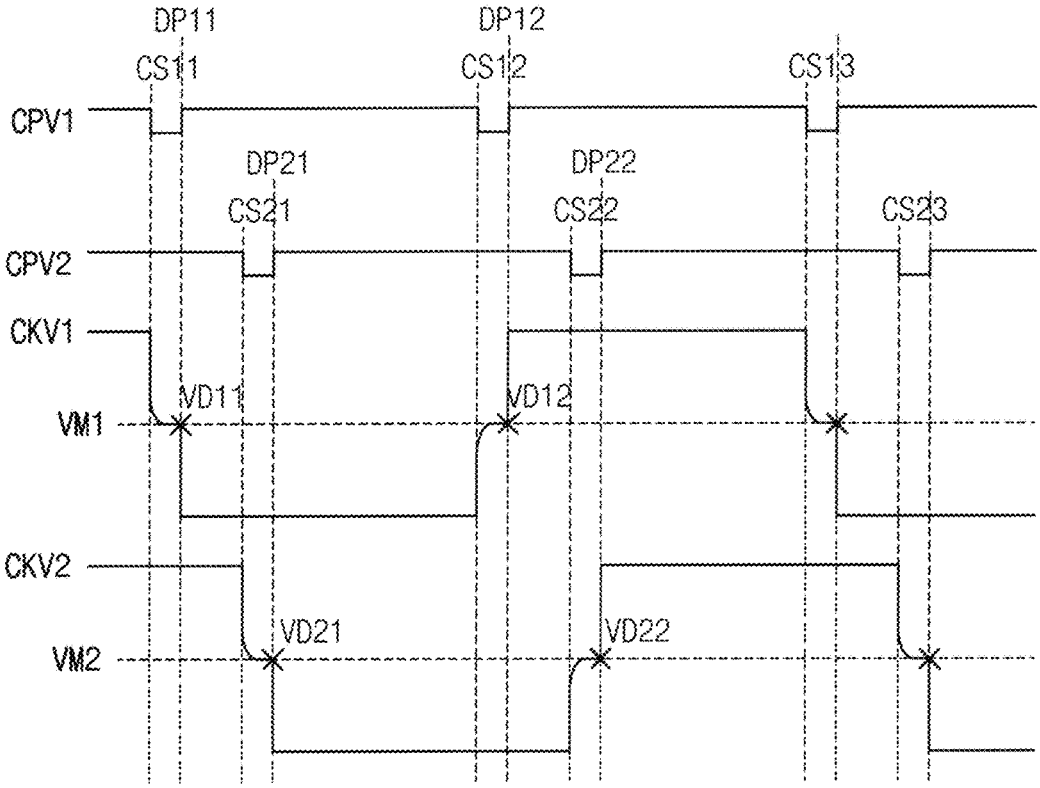
FIG. 5 is a timing diagram illustrating a sensing operation of a voltage sensor of FIG. 4 when a short between gate clock signal lines is not generated.
Figure 6:
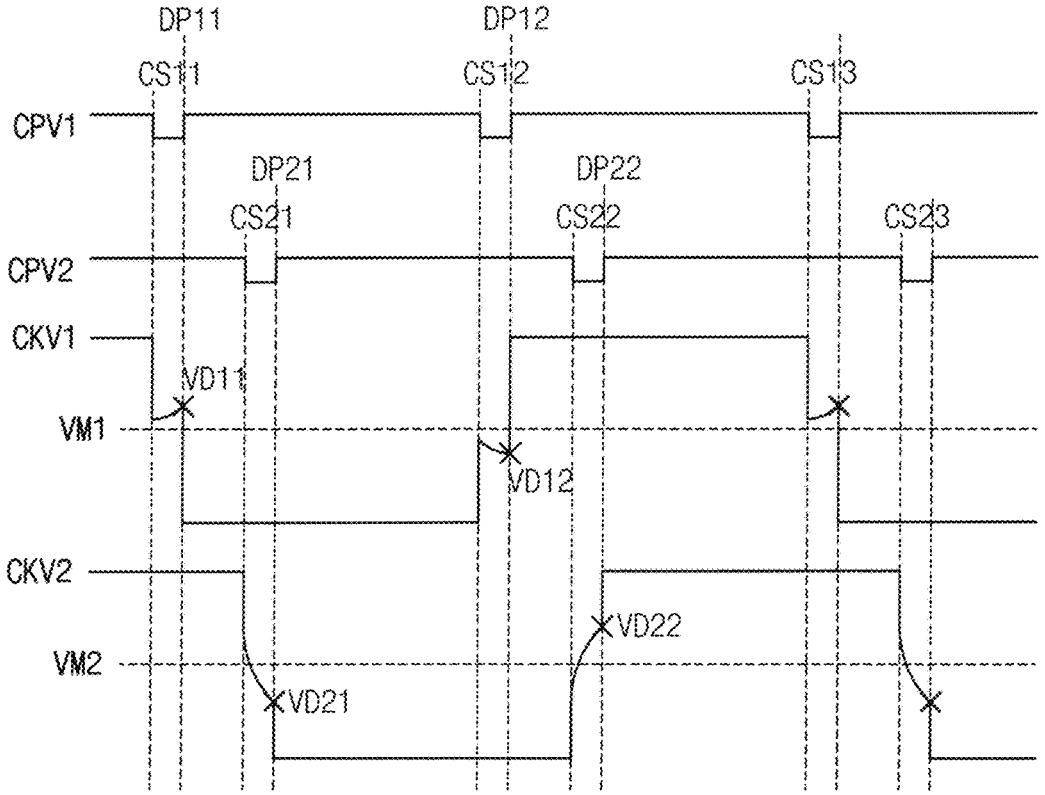
FIG. 6 is a timing diagram illustrating a sensing operation of the voltage sensor of FIG. 4 when the short between the gate clock signal lines is generated.

FIG. 4 is a block diagram illustrating the power voltage generator 600 of FIG. 1. FIG. 5 is a timing diagram illustrating a sensing operation of a voltage sensor 620 of FIG. 4 when a short between gate clock signal lines is not generated. FIG. 6 is a timing diagram illustrating a sensing operation of the voltage sensor 620 of FIG. 4 when the short between the gate clock signal lines is generated.

Referring to FIGS. 1 to 6, the power voltage generator 600 may include a voltage sensor 620, a comparator 640, and a power breaker 660.

The voltage sensor 620 may sense a first voltage VD11 in the first charge sharing period CS11 of the gate clock signal (e.g. CKV1) and a second voltage VD12 in the second charge sharing period CS12 of the gate clock signal (e.g. CKV1).

The comparator 640 may compare an absolute value of difference between the first voltage VD11 and the second voltage VD12 to a threshold value to generate a comparison signal.

The power breaker 660 may break (or disconnect) a power of the display apparatus based on the difference between the first voltage VD11 and the second voltage VD12. The power breaker 660 may break the power of the display apparatus based on the comparison signal.

In an embodiment, for example, the voltage sensor 620 may sense the first voltage VD11 at a rising edge DP11 of the first pulse of the gate clock control signal (e.g. CPV1). As a sensing point of the voltage of the gate clock signal (e.g. CKV1) is late in the first charge sharing period CS11, the change of the first voltage VD11 due to the short between the gate clock signal lines may be more accurately detected.

In an embodiment, for example, the voltage sensor 620 may sense the second voltage VD12 at a rising edge DP12 of the second pulse of the gate clock control signal (e.g. CPV1). As a sensing point of the voltage of the gate clock signal (e.g. CKV1) is late in the first charge sharing period CS11, the change of the second voltage VD12 due to the short between the gate clock signal lines may be more accurately detected.

In FIG. 5, a normal state, in which a short between a first gate clock signal line applying the first gate clock signal CKV1 and a second gate clock signal line applying the second gate clock signal CKV2 is not generated, is illustrated.

In this normal state, the first gate clock signal CKV1 may have a first voltage VD11 corresponding to a middle voltage VM1 of the first gate clock signal CKV1 at a first sensing point DP11, and the first gate clock signal CKV1 may have a second voltage VD12 corresponding to the middle voltage VM1 of the first gate clock signal CKV1 at a second sensing point DP12. Herein, the difference between the first voltage VD11 and the second voltage VD12 of the first gate clock signal CKV1 may be zero.

Similarly, the second gate clock signal CKV2 may have a first voltage VD21 corresponding to a middle voltage VM2 of the second gate clock signal CKV2 at a first sensing point DP21 and the second gate clock signal CKV2 may have a second voltage VD22 corresponding to the middle voltage VM2 of the second gate clock signal CKV2 at a second sensing point DP22. Herein, the difference between the first voltage VD21 and the second voltage VD22 of the second gate clock signal CKV2 may be zero.

In FIG. 6, an error state, in which a short between the first gate clock signal line applying the first gate clock signal CKV1 and the second gate clock signal line applying the second gate clock signal CKV2 is generated, is illustrated.

In the error state, the first gate clock signal CKV1 may have a first voltage VD11 greater than the middle voltage VM1 of the first gate clock signal CKV1 at the first sensing point DP11. Due to the short between the first gate clock signal line and the second gate clock signal line, the level of the first gate clock signal CKV1 may be pulled up toward a high level of the second gate clock signal CKV2 during the first charge sharing period CS11. The first gate clock signal CKV1 may have a second voltage VD12 less than the middle voltage VM1 of the first gate clock signal CKV1 at a second sensing point DP12. Due to the short between the first gate clock signal line and the second gate clock signal line, the level of the first gate clock signal CKV1 may be pulled down toward a low level of the second gate clock signal CKV2 during the second charge sharing period CS12.

For example, in FIG. 6, the first voltage VD11 of the first gate clock signal CKV1 may be 12 voltages (V), the second voltage VD12 of the first gate clock signal CKV1 may be 8V, and the absolute value of the difference of the first voltage VD11 and the second voltage VD12 may be 4V. When the threshold value is 2V, the comparator 640 may detect the short between the gate clock signal lines for the example of FIG. 6. Thus, the comparator 640 may output the comparison signal representing the short between the gate clock signal lines to the power breaker 660.

Similarly, the second gate clock signal CKV2 may have a first voltage VD21 less than the middle voltage VM2 of the second gate clock signal CKV2 at the first sensing point DP21. Due to the short between the first gate clock signal line and the second gate clock signal line, the level of the second gate clock signal CKV2 may be pulled down toward a low level of the first gate clock signal CKV1 during the first charge sharing period CS21. The second gate clock signal CKV2 may have a second voltage VD22 greater than the middle voltage VM2 of the second gate clock signal CKV2 at the second sensing point DP22. Due to the short between the first gate clock signal line and the second gate clock signal line, the level of the second gate clock signal CKV2 may be pulled up toward a high level of the first gate clock signal CKV1 during the second charge sharing period CS22.

In this case, the comparator 640 may detect the short between the gate clock signal lines based on the difference between the first voltage VD21 and the second voltage VD22 of the second gate clock signal CKV2.

However, the voltage (e.g. VD11) in a charge sharing period corresponding to a falling period of the gate clock signal and the voltage (e.g. VD12) in a charge sharing period corresponding to a rising period of the gate clock signal may have a slight difference even in the normal state according to characteristics of the display panel 100 and characteristics of the gate driver 300. Thus, the threshold value may be properly set considering the characteristics of the display panel 100 and the characteristics of the gate driver 300, not to detect a difference in the voltages due to the characteristics of the display panel 100 and the characteristics of the gate driver 300 as the difference due to the short.

The display panel 100 may be driven in a unit of a frame. The frame may include an active period when the image is written on the display panel 100 and a vertical blank period when the image is not written on the display panel 100.

In the present embodiment, the first charge sharing period CS11 and the second charge sharing period CS12 may be included in the active period, and the voltage sensor 620 may sense the first voltage VD11 and the second voltage VD12 in the active period. Alternatively, the first charge sharing period CS11 and the second charge sharing period CS12 may be included in the vertical blank period, and the voltage sensor 620 may sense the first voltage VD11 and the second voltage VD12 in the vertical blank period.

According to the present embodiment, the voltage of the gate clock signal CKV1 is detected in the charge sharing periods CS11 and CS12 of the gate clock signal CKV1 so that the short between the gate clock signal lines may be sensitively detected comparing to a conventional current sensing method.

Thus, the heat or the fire of the display apparatus, which may be generated when the existing short between the gate clock signal lines is not detected, may be prevented. Specifically, the heat or the fire of the display apparatus, which may be generated when the short between the gate clock signal lines is not detected at a lower portion of the display panel 100, may be prevented. Thus, the safety and the reliability of the display apparatus may be enhanced.

Figure 7:
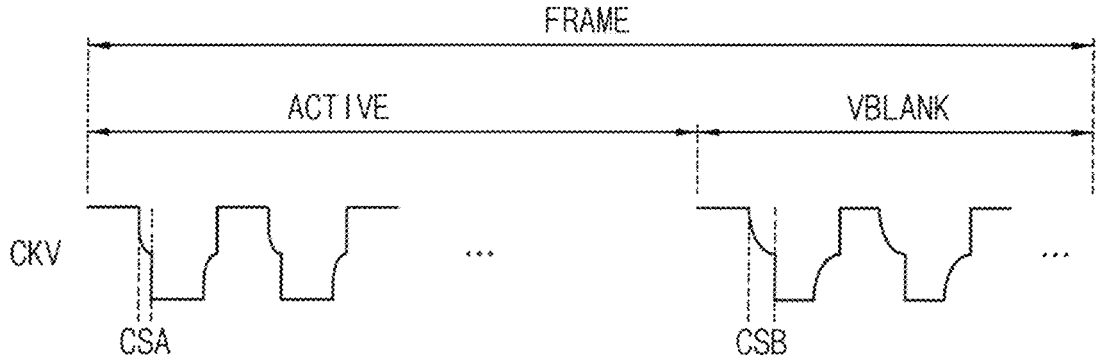
FIG. 7 is a timing diagram illustrating a gate clock signal in a display apparatus according to an embodiment of the present inventive concept.
Figure 8A:
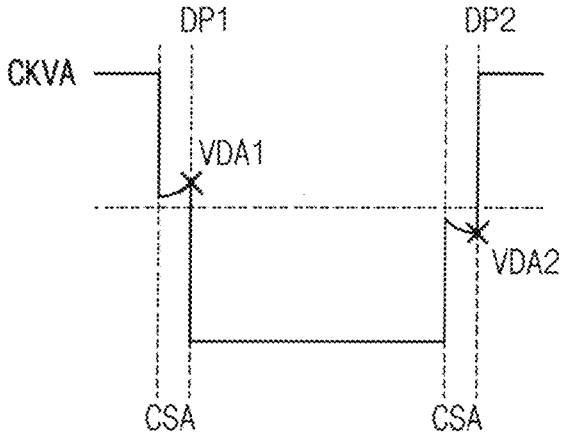
FIG. 8A is a timing diagram illustrating a gate clock signal when a voltage sensor of the display apparatus of FIG. 7 operates in an active period.
Figure 8B:
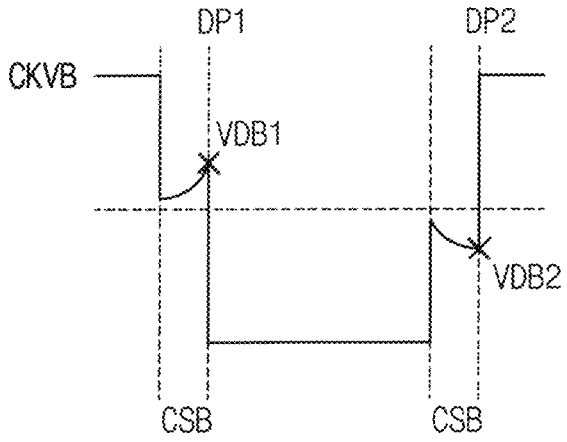
FIG. 8B is a timing diagram illustrating the gate clock signal when the voltage sensor of the display apparatus of FIG. 7 operates in a vertical blank period.

FIG. 7 is a timing diagram illustrating a gate clock signal in a display apparatus according to an embodiment of the present inventive concept. FIG. 8A is a timing diagram illustrating a gate clock signal when a voltage sensor 620 of the display apparatus of FIG. 7 operates in an active period. FIG. 8B is a timing diagram illustrating the gate clock signal when the voltage sensor 620 of the display apparatus of FIG. 7 operates in a vertical blank period.

The power voltage generator, the display apparatus including the power voltage generator, and the method of driving the display apparatus according to the present embodiment are substantially the same as the power voltage generator, the display apparatus including the power voltage generator and the method of driving the display apparatus of the previous embodiments explained referring to FIGS. 1 to 6, except that the voltage sensor senses the first voltage and the second voltage in the vertical blank period. Thus, the same reference numerals will be used to refer to the same or like parts as those described in the previous embodiment of FIGS. 1 to 6, and any repetitive explanation concerning the above elements will be omitted.

Referring to FIGS. 1 to 8B, the display panel 100 may be driven in a unit of a frame. The frame may include an active period ACTIVE when the image is written on the display panel 100 and a vertical blank period VBLANK when the image is not written on the display panel 100.

In the present embodiment, a length of an active charge sharing period CSA included in the active period ACTIVE may be different from a length of a blank charge sharing period CSB included in the vertical blank period VBLANK. For example, the length of the blank charge sharing period CSB may be longer than the length of the active charge sharing period CSA.

The image is not written on the display panel 100 in the vertical blank period VBLANK so that the display quality may hardly be affected even if the length of the blank charge sharing period CSB is adjusted.

In FIG. 8A, the first voltage VDA1 may be sensed in the first sensing point DP1 in the active charge sharing period CSA, and the second voltage VDA2 may be sensed in the second sensing point DP2 in the active charge sharing period CSA.

In FIG. 8B, the first voltage VDB1 may be sensed in the first sensing point DP1 in the blank charge sharing period CSB and the second voltage VDB2 may be sensed in the second sensing point DP2 in the blank charge sharing period CSB.

When the short between the gate clock signal lines is generated, the voltage of the gate clock signal gradually get farther from a normal level (the middle voltage) during the charge sharing period. Thus, when the charge sharing period CSA is short as shown in FIG. 8A, the difference between the first voltage VDA1 and the second voltage VDA2 may be relatively little. In contrast, when the charge sharing period CSB is long as shown in FIG. 8B, the difference between the first voltage VDB1 and the second voltage VDB2 may be relatively great.

Thus, in the present embodiment, the voltage sensor 620 may sense the first voltage VDB1 and the second voltage VDB2 in the charge sharing period CSB in the vertical blank period VBLANK. When the voltage sensor 620 senses the first voltage VDB1 and the second voltage VDB2 in the charge sharing period CSB of the vertical blank period VBLANK, the short between the gate clock signal lines may be more sensitively detected.

According to the present embodiment, the voltage of the gate clock signal is detected in a charge sharing period of the gate clock signal so that the short between the gate clock signal lines may be sensitively detected comparing to a conventional current sensing method.

During the vertical blank period VBLANK when the image is not written on the display panel 100, the charge sharing period of the gate clock signal may be extended. When the voltage of the gate clock signal is sensed in the extended charge sharing period, the short between the gate clock signal lines may be more sensitively detected.

Thus, the heat or the fire of the display apparatus, which may be generated when the short between the gate clock signal lines is not detected, may be prevented. Specifically, the heat or the fire of the display apparatus, which may be generated when the short between the gate clock signal lines is not detected at a lower portion of the display panel 100, may be prevented. Thus, the safety and the reliability of the display apparatus may be enhanced.

Figure 9:
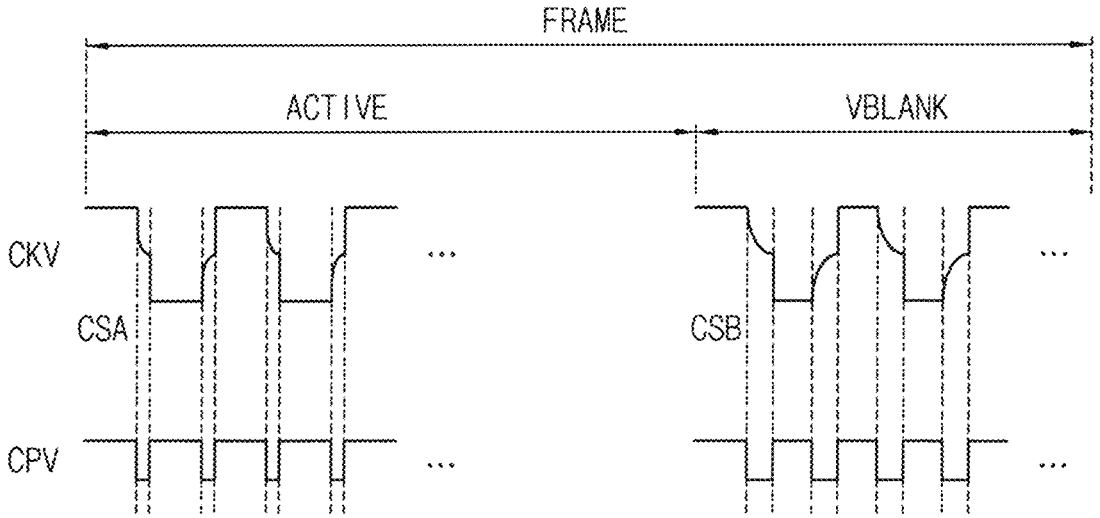
FIG. 9 is a timing diagram illustrating a gate clock signal and a gate clock control signal in a display apparatus according to an embodiment of the present inventive concept.

FIG. 9 is a timing diagram illustrating a gate clock signal and a gate clock control signal in a display apparatus according to an embodiment of the present inventive concept.

The power voltage generator, the display apparatus including the power voltage generator, and the method of driving the display apparatus according to the present embodiment is substantially the same as the power voltage generator, the display apparatus including the power voltage generator, and the method of driving the display apparatus of the previous embodiment explained referring to FIGS. 7 to 8B, except that the charge sharing period is controlled in response to the gate clock control signal. Thus, the same reference numerals will be used to refer to the same or like parts as those described in the previous embodiment of FIGS. 1 to 6, and any repetitive explanation concerning the above elements will be omitted.

Referring to FIGS. 1 to 6, 8A, 8B and 9, the display panel 100 may be driven in a unit of a frame. The frame may include an active period ACTIVE when the image is written on the display panel 100 and a vertical blank period VBLANK when the image is not written on the display panel 100.

In the present embodiment, a length of an active charge sharing period CSA included in the active period ACTIVE may be different from a length of a blank charge sharing period CSB included in the vertical blank period VBLANK. For example, the length of the blank charge sharing period CSB may be longer than the length of the active charge sharing period CSA.

The image is not written on the display panel 100 in the vertical blank period VBLANK so that the display quality may hardly be affected even if the length of the blank charge sharing period CSB is adjusted.

In the present embodiment, the active charge sharing period CSA and the blank charge sharing period CSB may be controlled in response to the gate clock control signal CPV. Thus, a pulse width of the gate clock control signal CPV in the vertical blank period VBLANK may be wider than a pulse width of the gate clock control signal CPV in the active period ACTIVE.

When the short between the gate clock signal lines is generated, the voltage of the gate clock signal gradually get farther from a normal level (the middle voltage) during the charge sharing period. Thus, when the charge sharing period CSA is short as shown in FIG. 8A, the difference between the first voltage VDA1 and the second voltage VDA2 may be relatively little. In contrast, when the charge sharing period CSB is long as shown in FIG. 8B, the difference between the first voltage VDB1 and the second voltage VDB2 may be relatively great.

Thus, in the present embodiment, the voltage sensor 620 may sense the first voltage VDB1 and the second voltage VDB2 in the charge sharing period CSB in the vertical blank period VBLANK. When the voltage sensor 620 senses the first voltage VDB1 and the second voltage VDB2 in the charge sharing period CSB in the vertical blank period VBLANK, the short between the gate clock signal lines may be more sensitively detected.

According to the present embodiment, the voltage of the gate clock signal is detected in a charge sharing period of the gate clock signal so that the short between the gate clock signal lines may be sensitively detected comparing to a conventional current sensing method.

During the vertical blank period VBLANK when the image is not written on the display panel 100, the charge sharing period of the gate clock signal may be extended. When the voltage of the gate clock signal is sensed in the extended charge sharing period, the short between the gate clock signal lines may be more sensitively detected.

Thus, the heat or the fire of the display apparatus, which may be generated when the short between the gate clock signal lines is not detected, may be prevented. Specifically, the heat or the fire of the display apparatus, which may be generated when the short between the gate clock signal lines is not detected at a lower portion of the display panel 100, may be prevented. Thus, the safety and the reliability of the display apparatus may be enhanced.

According to the present inventive concept as explained above, the safety and the reliability of the display apparatus may be enhanced.

The foregoing is illustrative of the present inventive concept and is not to be construed as limiting thereof. Although a few embodiments of the present inventive concept have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein.

What is claimed is:

1. A power voltage generator comprising:

a voltage sensor which senses a first voltage in a first charge sharing period of a gate clock signal and a second voltage in a second charge sharing period of the gate clock signal; and a power breaker which disconnects a power based on a difference between the first voltage and the second voltage, wherein the first charge sharing period and the second charge sharing period are discrete from and nonoverlapping with each other.

2. The power voltage generator of claim 1, further comprising a comparator which compares an absolute value of a difference of the first voltage and the second voltage to a threshold value to generate a comparison signal.

3. The power voltage generator of claim 1, wherein the gate clock signal and a gate inverted clock signal which is an inverted signal of the gate clock signal are temporarily connected to each other in the first charge sharing period.

4. The power voltage generator of claim 1, wherein the first charge sharing period corresponds to a falling period of the gate clock signal, and the second charge sharing period corresponds to a rising period of the gate clock signal.

5. The power voltage generator of claim 1, wherein the first charge sharing period and the second charge sharing period are controlled in response to a gate clock control signal.

6. The power voltage generator of claim 5, wherein the voltage sensor is configured to sense the first voltage at a rising edge of a first pulse of the gate clock control signal, and wherein the voltage sensor is configured to sense the second voltage at a rising edge of a second pulse of the gate clock control signal adjacent to the first pulse of the gate clock control signal.

7. The power voltage generator of claim 1, wherein the first charge sharing period and the second charge sharing period are included in an active period when an image is written on a display area of a display panel, and wherein the voltage sensor is configured to sense the first voltage and the second voltage in the active period.

8. The power voltage generator of claim 1, wherein a length of a blank charge sharing period included in a vertical blank period when an image is not written on a display area of a display panel is longer than a length of an active charge sharing period included in an active period when an image is written on the display area of the display panel.

9. The power voltage generator of claim 8, wherein the first charge sharing period and the second charge sharing period are the blank charge sharing period included in the vertical blank period, and wherein the voltage sensor is configured to sense the first voltage and the second voltage in the vertical blank period.

10. The power voltage generator of claim 9, wherein the active charge sharing period and the blank charge sharing period are controlled in response to a gate clock control signal, and wherein a pulse width of the gate clock control signal in the vertical blank period is wider than a pulse width of the gate clock control signal in the active period.

11. A display apparatus comprising:

a display panel including a gate line, a data line, and a pixel electrically connected to the gate line and the data line, wherein the display panel displays an image based on input image data;

a gate driver which outputs a gate signal to the gate line;

a data driver which outputs a data voltage to the data line; and a power voltage generator which provides driving voltages to the display panel, the gate driver and the data driver, wherein the power voltage generator comprises:

a voltage sensor which senses a first voltage in a first charge sharing period of a gate clock signal and a second voltage in a second charge sharing period of the gate clock signal; and a power breaker which stops providing the driving voltages based on a difference between the first voltage and the second voltage, and wherein the first charge sharing period and the second charge sharing period are discrete from and nonoverlapping with each other.

12. The display apparatus of claim 11, wherein the gate driver is disposed in the display panel, wherein the power voltage generator is configured to output the gate clock signal to the gate driver, and wherein the power voltage generator is configured to stop providing the driving voltages when a short between the gate clock signal lines configured to apply the gate clock signals is detected.

13. The display apparatus of claim 11, wherein the first charge sharing period corresponds to a falling period of the gate clock signal, and the second charge sharing period corresponds to a rising period of the gate clock signal.

14. The display apparatus of claim 11, further comprising a driving controller which outputs a gate clock control signal which controls the first charge sharing period and the second charge sharing period to the power voltage generator.

15. The display apparatus of claim 14, wherein the voltage sensor is configured to sense the first voltage at a rising edge of a first pulse of the gate clock control signal, and wherein the voltage sensor is configured to sense the second voltage at a rising edge of a second pulse of the gate clock control signal adjacent to the first pulse of the gate clock control signal.

16. The display apparatus of claim 11, wherein a length of a blank charge sharing period included in a vertical blank period when an image is not written on a display area of the display panel is longer than a length of an active charge sharing period included in an active period when an image is written on the display area of the display panel.

17. The display apparatus of claim 16, wherein the first charge sharing period and the second charge sharing period are the blank charge sharing period included in the vertical blank period, and wherein the voltage sensor is which senses the first voltage and the second voltage in the vertical blank period.

18. A method of driving a display apparatus, the method comprising:

generating a gate clock signal based on a gate clock control signal;

providing the gate clock control signal to a gate driver;

sensing a first voltage in a first charge sharing period of the gate clock signal;

sensing a second voltage in a second charge sharing period of the gate clock signal;

detecting a short between gate clock signal lines based on a difference between the first voltage and the second voltage; and stopping providing a power to the display apparatus when the short between the gate clock signal lines is detected, wherein the first charge sharing period and the second charge sharing period are discrete from and nonoverlapping with each other.

19. The method of claim 18, wherein the first charge sharing period corresponds to a falling period of the gate clock signal, and the second charge sharing period corresponds to a rising period of the gate clock signal.

20. The method of claim 18, wherein a length of a blank charge sharing period included in a vertical blank period when an image is not written on a display area of a display panel is longer than a length of an active charge sharing period included in an active period when an image is written on the display area of the display panel, wherein the first charge sharing period and the second charge sharing period are the blank charge sharing period included in the vertical blank period, and wherein a voltage sensor is configured to sense the first voltage and the second voltage in the vertical blank period.

* * * * *